US007358941B2

(12) United States Patent
Ono et al.

(10) Patent No.: US 7,358,941 B2
(45) Date of Patent: Apr. 15, 2008

(54) IMAGE DISPLAY APPARATUS USING CURRENT-CONTROLLED LIGHT EMITTING ELEMENT

(75) Inventors: Shinya Ono, Shiga (JP); Yoshinao Kobayashi, Shiga (JP)

(73) Assignees: Kyocera Corporation, Kyoto (JP); Chi Mei Optoelectronics Corp., Tainan County (TW)

( * ) Notice: Subject to any disclaimer, the term of this patent is extended or adjusted under 35 U.S.C. 154(b) by 543 days.

(21) Appl. No.: 10/779,682

(22) Filed: Feb. 18, 2004

(65) Prior Publication Data

US 2004/0239596 A1 Dec. 2, 2004

(30) Foreign Application Priority Data

Feb. 19, 2003 (JP) ..... 2003-041824

(51) Int. Cl.
*G09G 3/32* (2006.01)

(52) U.S. Cl. ..... 345/82; 345/83

(58) Field of Classification Search ..... 345/76, 345/82, 55, 44–46, 89, 204–206, 87, 92, 345/80, 104, 74.1, 212; 315/169.3; 250/231.13; 358/447; 327/543
See application file for complete search history.

(56) References Cited

U.S. PATENT DOCUMENTS 4,827,351 A * 5/1989 Sakamoto ..... 358/447
5,581,274 A * 12/1996 Tagawa ..... 345/104
6,040,809 A * 3/2000 Friedman ..... 345/74.1
6,169,528 B1 * 1/2001 Oguchi et al. ..... 345/74.1
6,259,422 B1 * 7/2001 Hamamoto ..... 345/74.1
6,278,426 B1 * 8/2001 Akiyama ..... 345/87
6,335,715 B1 * 1/2002 Lee ..... 345/87
6,373,454 B1 * 4/2002 Knapp et al. ..... 345/76
6,535,185 B2 * 3/2003 Kim et al. ..... 345/76
6,583,775 B1 * 6/2003 Sekiya et al. ..... 345/76
6,590,445 B2 * 7/2003 Ueda ..... 327/543
6,686,699 B2 * 2/2004 Yumoto ..... 315/169.3
6,693,388 B2 * 2/2004 Oomura ..... 315/169.3
6,870,522 B2 * 3/2005 Sagano et al. ..... 345/75.2
7,046,240 B2 * 5/2006 Kimura ..... 345/212
2001/0019327 A1 * 9/2001 Kim et al. ..... 345/204
2001/0026251 A1 * 10/2001 Hunter et al. ..... 345/55
2001/0048073 A1 * 12/2001 Suzuki et al. ..... 250/231.13
2002/0180680 A1 * 12/2002 Moon ..... 345/89
2002/0195964 A1 * 12/2002 Yumoto ..... 315/169.3
2003/0063110 A1 * 4/2003 Sagano et al. ..... 345/694
2003/0122759 A1 * 7/2003 Abe et al. ..... 345/89

FOREIGN PATENT DOCUMENTS

JP 8-234683 (A) 9/1996

* cited by examiner

*Primary Examiner*—Prabodh Dharia
(74) *Attorney, Agent, or Firm*—Birch, Stewart, Kolasch & Birch, LLP

(57) ABSTRACT

A pixel circuit includes a driver element that is supplied with a potential from a data line. The driver element controls a value of current passing through an electric light emitting element. Upon obtaining a threshold voltage, a conductive member connected to the electric light emitting element is made to be a floating state to cause the driver element to become on-state, variations in the potential of the conductive member caused by charges passing through the driver element to flow into the conductive member are detected by a threshold voltage detector to obtain the threshold voltage of the driver element.

10 Claims, 9 Drawing Sheets

IMAGE DISPLAY APPARATUS USING CURRENT-CONTROLLED LIGHT EMITTING ELEMENT

BACKGROUND OF THE INVENTION

1) Field of the Invention

The present invention relates to an image display apparatus using a current-controlled light emitting element, and more particularly to an active matrix image display apparatus which controls brightness uniformly across its display unit.

2) Description of the Related Art

An organic electro-luminescence (EL) display apparatus using a self-luminous organic EL element (Organic Light Emitting Diode) does not need a backlight, which is required for a liquid crystal display device. This organic EL display apparatus is therefore suitable for a thin display device, and its practical use as a next generation display device has been expected because of no restriction in a view angle.

An image display apparatus using the organic EL element can employ a simple (passive) matrix type and an active matrix type as a drive system. The former has a simple configuration but has a difficulty in realization of a large-size and high-definition display. Therefore, in recent years, the active matrix display device has been extensively developed. The active matrix display device controls a current passing through a light emitting element inside a pixel by an active element, for example, a thin film transistor provided in the pixel.

Shown in FIG. 9 is a pixel circuit in an active matrix organic EL display device according to the conventional technology. The pixel circuit according to the conventional technology includes an organic EL element 105 whose positive side is connected to a positive power supply Vdd, a thin film transistor 104 whose drain electrode is connected to a negative side of the organic EL element 105 and source electrode is connected to the ground, and that functions as a driver element. The pixel circuit also includes a capacitor 103 that is connected between a gate electrode of the thin film transistor 104 and the ground, and a thin film transistor 102 whose drain electrode is connected to the gate electrode of the thin film transistor 104, whose source electrode is connected to a data line 101, and whose gate electrode is connected to a scan line 106, and that functions as a switching element.

The operation of the pixel circuit is explained below. When the potential of the scan line 106 is at a high level, the thin film transistor 102 becomes on-state, and by applying a write potential to the data line 101, the capacitor 103 is charged or discharged, and a predetermined potential is written to the gate electrode of the thin film transistor 104. Next, When the potential of the scan line 106 is at a low level, the thin film transistor 102 is not energized, and the scan line 106 and the thin film transistor 102 are electrically disconnected, but the gate potential of the thin film transistor 104 is stably maintained by the capacitor 103.

The current passing through the thin film transistor 104 and the organic EL element 105 becomes a value corresponding to a gate-source potential Vgs of the thin film transistor 104, and the organic EL element 105 continues light emission with a brightness corresponding to the current value. By performing a write with a potential once in the pixel circuit as shown in FIG. 9, the organic EL element 105 continues light emission with a constant brightness until the next write is performed (e.g., see Japanese Patent Application Laid Open No. H8-234683).

Incidentally, the thin film transistor 104 that functions as the driver element in the image display apparatus includes a channel layer for which polycrystalline silicon or amorphous silicon is generally used. In the image display apparatus in which many pixels are arranged and many driver elements are provided corresponding to the respective pixels, it is preferable to use amorphous silicon in order to suppress variations in characteristics among thin film transistors.

However, when the thin film transistor whose channel layer is formed of amorphous silicon is used as the driver element, there exists a problem such that the conventional image display apparatus as shown in FIG. 9 has a difficulty in keeping high-quality image display over a long period of time. This is because in the thin film transistor using the amorphous silicon, it is known that a threshold voltage varies gradually by passing a current through the channel layer over the long period of time and that the value of the current passing through the channel layer changes according to the variations in the threshold voltage even if it is continuously applied with a constant gate voltage. As explained above, the organic EL element 105 is serially connected to the thin film transistor 104, and therefore, the value of the current passing through the organic EL element 105 changes according to the variations in the value of a current passing through the channel layer. Therefore, even if the same potential is supplied from the data line 101, the brightness of the organic EL element 105 varies according to variations in the threshold voltage, which makes it difficult to display a high-quality image.

Therefore, in an actual image display apparatus in which the thin film transistor using the amorphous silicon is used as the driver element, a voltage compensation circuit is arranged for each pixel in addition to the pixel circuit as shown in FIG. 9. More specifically, in addition to a potential that is supplied from the data line 101, a potential for compensating for a variation of the threshold voltage is supplied from the voltage compensation circuit to the gate electrode of the thin film transistor 104. This configuration allows high-quality image display. However, such a voltage compensation circuit includes a few pieces of thin film transistors per pixel, which causes an area for the voltage compensation circuit to be separately provided on a substrate where the organic EL elements are arranged. Consequently, the organic EL elements 105 cannot be densely arranged thereon, which causes occurrence of a new problem such that it becomes difficult to perform high-definition image display.

Furthermore, it is known that degradation in the channel layer causes not only the threshold voltage of the thin film transistor 104 but also the current passing according to the gate potential to change, so-called a slope of a linear area to vary. Although the brightness is affected by the variation of the slope of the linear area less than the variation of the threshold voltage, the variation of the slope should not be neglected in order to perform high-quality image display.

SUMMARY OF THE INVENTION

It is an object of the present invention to solve at least the problems in the conventional technology.

An image display apparatus according to the present invention includes a current-controlled light emitting element that emits light with a brightness corresponding to a current flowing in the current-controlled light emitting element; a current source that supplies the current to the current-controlled light emitting element; a driver element that includes at least first and second terminals and controls the current flowing into the current-controlled light emitting element from the current source based on a potential difference applied between the terminals; a data line that supplies a potential to the first terminal; a conductive member that is electrically connected to the second terminal; and a threshold voltage obtaining unit that obtains a threshold voltage of the driver element based on the potential of the conductive member corresponding to an amount of charges supplied from the current source to the second terminal.

The other objects, features, and advantages of the present invention are specifically set forth in or will become apparent from the following detailed descriptions of the invention when read in conjunction with the accompanying drawings.

DETAILED DESCRIPTION

Figure 1:
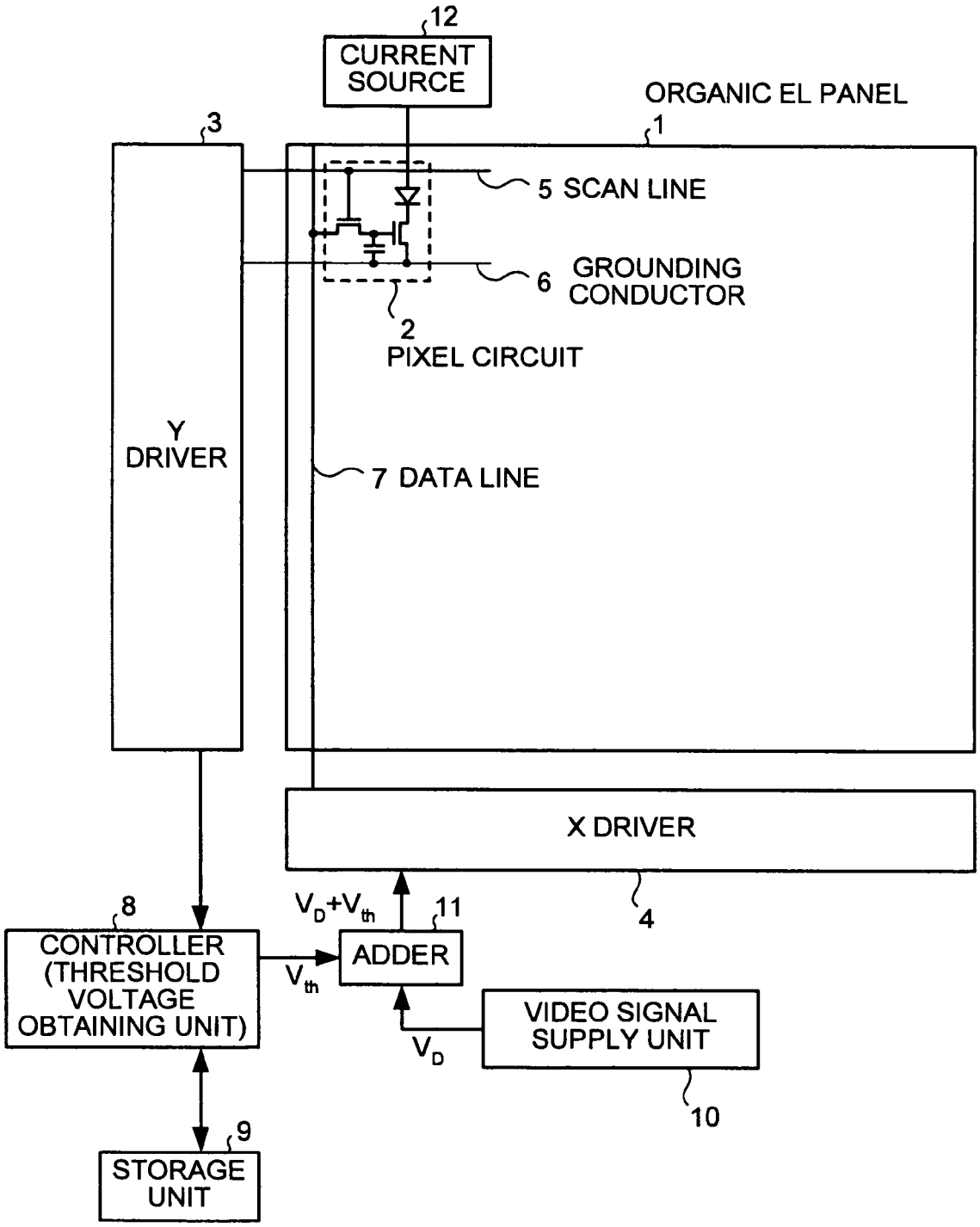
FIG. 1 is a diagram of an entire configuration of an image display apparatus according to a first embodiment.

Exemplary embodiments of the image display apparatus according to the present invention are explained in detail below with reference to the drawings. It is to be noted that the drawings are schematically provided and therefore different from real ones. Furthermore, some parts in which mutual dimensions or ratios are different are certainly included in the drawings.

An image display apparatus according to a first embodiment of the present invention is explained below. The image display apparatus is an active matrix image display apparatus using a thin film transistor as a driver element. A gate-source voltage is obtained by a controller so that the driver element is made to be on-state once in a state in which potential control of a grounding conductor that is connected to the driver element is stopped, charge is accumulated in the grounding conductor, and after this, the driver element becomes off-state again. Upon displaying an image, the threshold voltage obtained and a data voltage corresponding to a display brightness are applied to the gate electrode of the driver element to perform image display.

FIG. 1 is a schematic diagram of the entire configuration of the image display apparatus according to the first embodiment. As shown in FIG. 1, the image display apparatus according to the first embodiment includes an organic EL panel 1 with a large number of pixel circuits 2 that are arranged in a matrix, a Y driver 3 connected to the organic EL panel 1 through a scan line 5 and a grounding conductor (conductive member) 6, and an X driver 4 connected thereto through a data line 7. The grounding conductor 6 functions as one example of a conductive member in a scope of the claims, and is electrically connected to the driver element, explained later. The Y driver 3 has a configuration capable of outputting a predetermined electrical signal to the outside, and the electrical signal output is input to a controller (threshold voltage obtaining unit) 8 and stored in a storage unit 9 as numerical data. The controller 8 performs general controls for the components and functions as one example of a threshold voltage obtaining unit in the scope of the claims. Furthermore, the image display apparatus includes an adder 11 that adds the electrical signal output from the controller 8 and an electrical signal corresponding to a display image output from a video signal supply unit 10, and the electrical signal as the result of addition is supplied to the pixel circuits 2 through the X driver 4. The image display apparatus further includes a current source 12 that supplies a current to a current-controlled light emitting element included in the pixel circuit 2.

Figure 2:
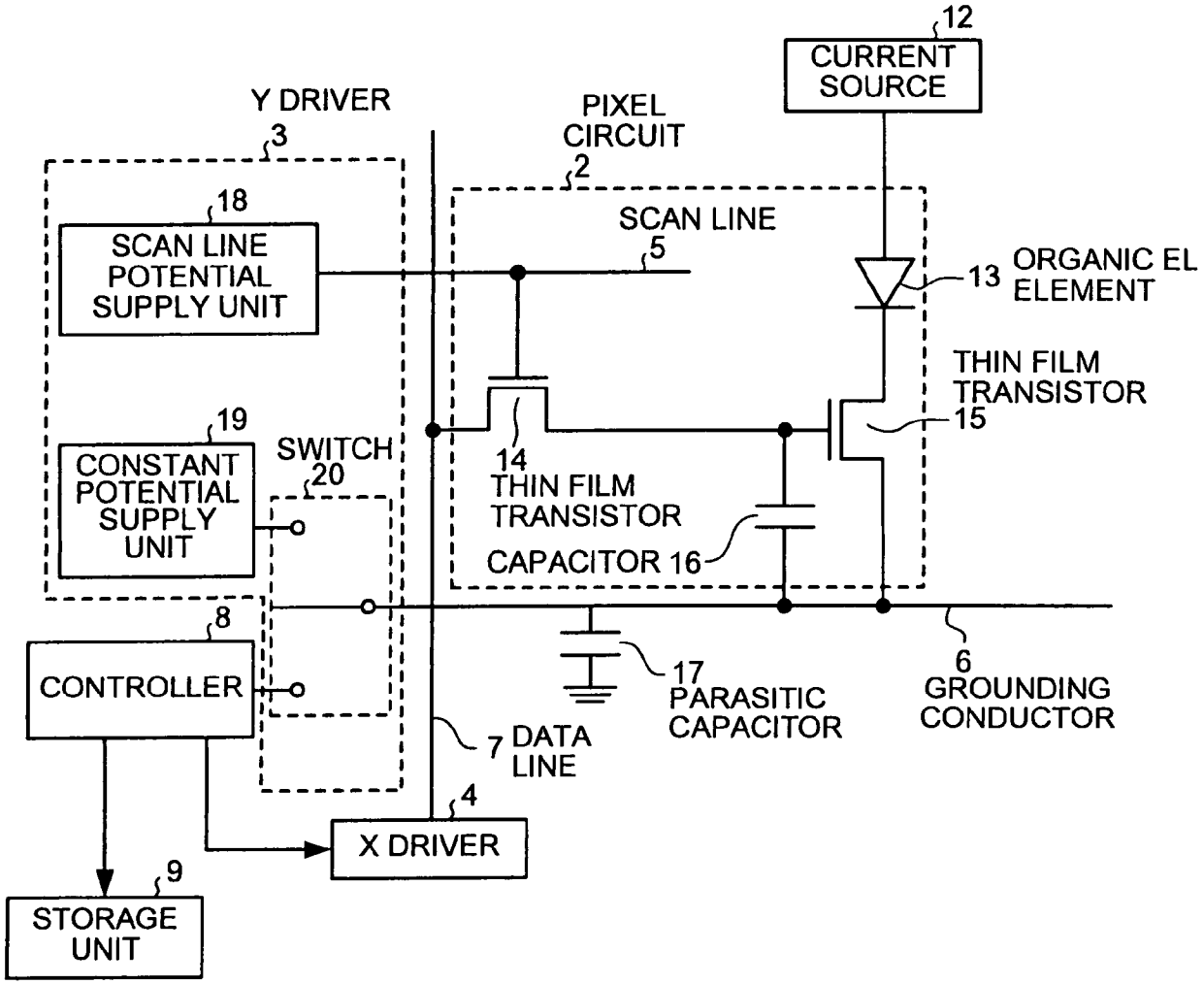
FIG. 2 is a diagram of a relation between a pixel circuit and a peripheral circuit of the pixel circuit that forms the image display apparatus.

FIG. 2 is a diagram of a circuit configuration of the pixel circuit 2 and components around the pixel circuit 2. It is noted that FIG. 2 is only provided to facilitate understanding of the image display apparatus according to the first embodiment, and therefore, it should be noted that this configuration is not always the same as an actual configuration.

As shown in FIG. 2, the pixel circuit 2 includes a thin film transistor 14 whose gate electrode is connected with the scan line 5, one of whose source/drain electrodes is connected with the data line 7, and that functions as a switching element. The pixel circuit 2 also includes a thin film transistor 15 whose gate electrode (first terminal) is connected with the other one of the source/drain electrodes of the thin film transistor 14, and that functions as the driver element. The pixel circuit 2 further includes an organic EL element 13 whose anode electrode is connected to the drain electrode of the thin film transistor 15 and whose cathode electrode is connected to the current source 12, and a capacitor 16 that is connected to the gate electrode of the thin film transistor 15. The organic EL element 13 is connected to the current source 12. A source electrode (second terminal) of the thin film transistor 15 is connected to the grounding conductor 6, and the capacitor 16 for maintaining a written potential is disposed between the gate electrode of the thin film transistor 15 and the grounding conductor 6. Parasitic capacitor 17 exists between the grounding conductor 6 and another interconnection structure existing in the organic EL panel 1.

As shown in FIG. 2, the Y driver 3 includes a scan line potential supply unit 18 electrically connected to the scan line 5, and a constant potential supply unit 19 connectable to the grounding conductor 6. The Y driver 3 further includes a switch (switching unit) 20 that selects either the constant potential supply unit 19 or the controller 8 as a connection destination of the grounding conductor 6. The switch 20 functions as one example of a switching unit in the scope of the claims.

The scan line potential supply unit 18 supplies potential to the scan line 5 so as to control a drive state of the thin film transistor 14. More specifically, in order to supply potential from the data line 7 to the thin film transistor 15 upon writing the potential in the thin film transistor 15 as the driver element, the thin film transistor 14 as the switching element has to be turned on. Before the potential is written in the thin film transistor 15, the scan line potential supply unit 18 allows the thin film transistor 14 to turn on by supplying a predetermined potential to the gate electrode of the thin film transistor 14 through the scan line 5, thereby allowing to write the potential in the thin film transistor 15.

The constant potential supply unit 19 maintains the grounding conductor 6 at a constant potential. In other words, the capacitor 16 is disposed between the grounding conductor 6 and the gate electrode of the thin film transistor 15 so as to maintain the potential written therein. Variations in the potential of the grounding conductor 6 affect the potential of the gate electrode of the thin film transistor 15 that is connected to the capacitor 16, resulting in variations in the potential of the gate electrode. Therefore, this affects the value of a current passing through the channel layer of the thin film transistor 15 to cause the brightness of the organic EL element 13 to vary. Variations in the potential of the grounding conductor 6 cause the voltage across the anode and the cathode of the organic EL element 13 to vary, which causes the brightness to vary. In order to avoid such detrimental effect, the grounding conductor 6 is connected to the constant potential supply unit 19 upon performing image display to maintain the potential at a constant potential, generally, at 0 potential.

The switch 20 is used to switch a connection destination of the grounding conductor 6. As explained above, in order to maintain the potential of the grounding conductor 6 at a constant level upon performing image display, the switch 20 connects the grounding conductor 6 to the constant potential supply unit 19. On the other hand, as explained later, to obtain a threshold voltage of the thin film transistor 15, it is required that the grounding conductor 6 is first made to function as being floating and then the potential of the grounding conductor 6 is measured. Therefore, the switch 20 isolates the grounding conductor 6 from the constant potential supply unit 19 upon obtaining the threshold voltage and connects the grounding conductor 6 to the controller 8. The controller 8 has a function of enabling obtaining of the potential of the grounding conductor 6, which hardly affects the potential of the grounding conductor 6. Therefore, when the grounding conductor 6 and the controller 8 are connected to each other by the switch 20, the grounding conductor 6 functions practically as being floating.

Figure 3A:
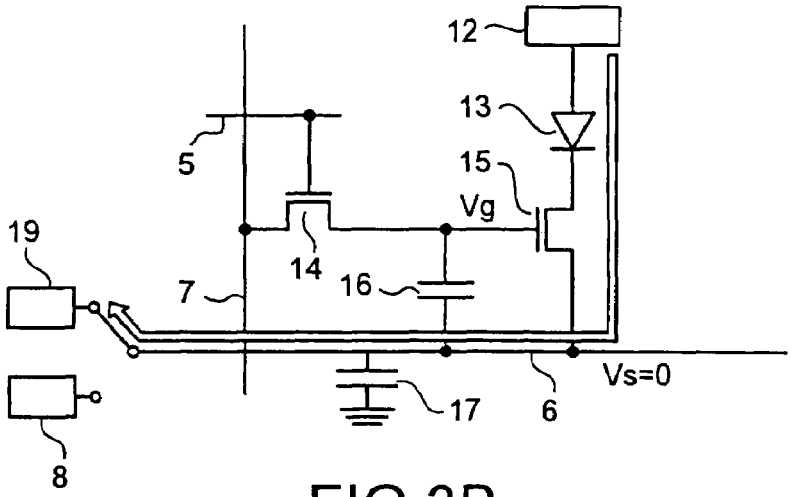
FIGS. 3A, 3B, and 3C are diagrams for explaining operations of the image display apparatus according to the first embodiment.

The operation of the image display apparatus according to the first embodiment is explained below. Shown in FIG. 3A is a state of the pixel circuit 2 when an image is displayed. Shown in FIG. 3B and FIG. 3C are states of the pixel circuit 2 when a threshold voltage of the thin film transistor 15 is obtained.

At first, the operation of the image display apparatus upon performing image display is simply explained. As shown in FIG. 3A, the grounding conductor 6 and the constant potential supply unit 19 are connected to each other upon performing image display, the potential of the grounding conductor 6 is maintained at a predetermined value, for example, at 0 potential, and a source electrode potential Vs of the thin film transistor 15 connected to the grounding conductor 6 is also maintained at 0 potential. A high potential is supplied from the scan line 5 to the thin film transistor 14 to cause it to turn on, and a potential supplied from the data line 7 is supplied to the gate electrode of the thin film transistor 15 and the capacitor 16. Therefore, a gate-source voltage of the thin film transistor 15 becomes Vg. Here, assuming that potential Vg supplied is an adequate potential for turning on the thin film transistor 15, a current with a value corresponding to the value of the potential Vg passes through the channel layer of the thin film transistor 15. Since the organic EL element 13 as a light emitting element is connected to the thin film transistor 15, a current equivalent to that in the channel layer of the thin film transistor 15 passes through the organic EL element 13, and the organic EL element 13 emits light with a brightness according to the value of the current.

The operation of the image display apparatus when a threshold voltage is to be obtained is explained below. As shown in FIG. 3B, upon obtaining the threshold voltage, the grounding conductor 6 is isolated from the constant potential supply unit 19 and connected to the controller 8. Therefore, when the threshold voltage is obtained, potential control is not performed on the grounding conductor 6, and therefore, the grounding conductor 6 functions practically as being floating.

Figure 3B:
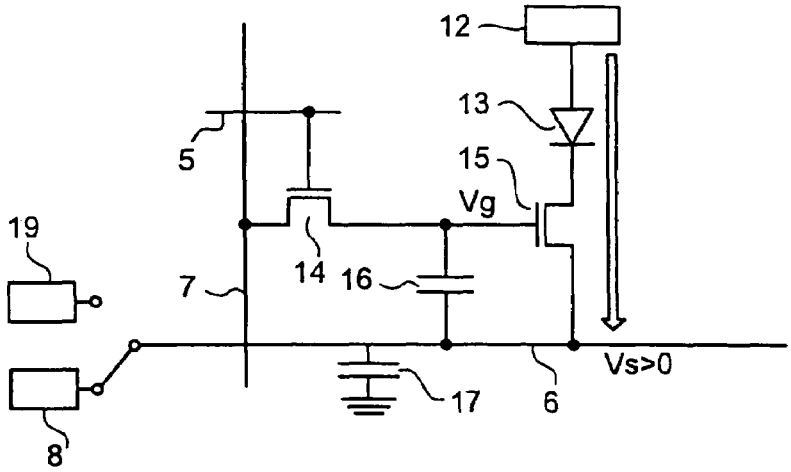
Figure 3C:
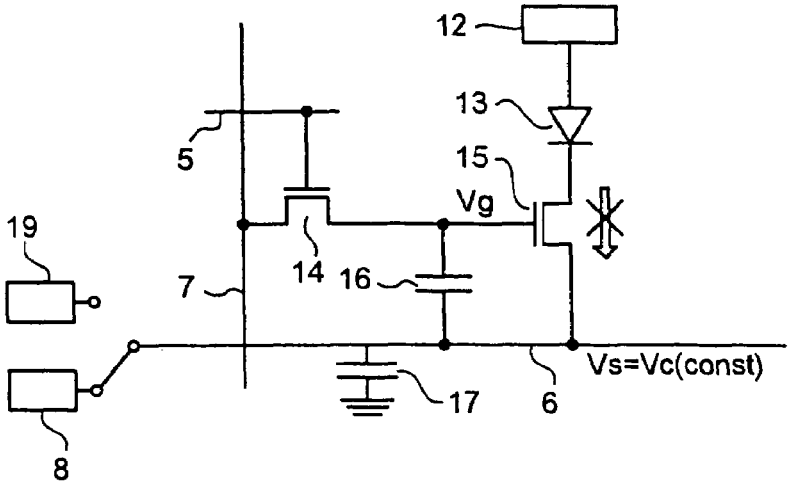

In the circuit in a connection-state as shown in FIG. 3B, a gate electrode potential Vg is set to a predetermined value in the same manner as that upon performing image display to cause the thin film transistor 15 to turn on, and a current is passed from the current source 12 to the grounding conductor 6 through the organic EL element 13 and the thin film transistor 15. As explained above, since the grounding conductor 6 functions as being floating, charges are gradually accumulated in the grounding conductor 6 caused by the inflow current. Therefore, the potential of the grounding conductor 6 rises from 0 and the source electrode potential Vs of the thin film transistor 15 connected to the grounding conductor 6 becomes a value higher than 0. Since the gate electrode potential Vg supplied through the data line 7 is maintained at a substantially constant value, a gate-source voltage (=Vg−Vs) of the thin film transistor 15 becomes lower than Vg.

The current continuously flows into the grounding conductor 6 from the current source 12 as long as the thin film transistor 15 is kept in on-state, and the potential of the grounding conductor 6 and the source electrode potential Vs of the thin film transistor 15 connected to the grounding conductor 6 continuously rises based on the charges accumulated. On the other hand, the gate electrode potential Vg of the thin film transistor 15 is maintained at a substantially constant value, and therefore, the gate-source voltage gradually lowers according to the rise of the source electrode potential Vs.

When the gate-source voltage of the thin film transistor 15 has lowered to a threshold voltage of the thin film transistor 15, the thin film transistor 15 becomes off-state, and inflow of a current from the current source 12 stops, as shown in FIG. 3C, which causes the rise of the potential Vs also to stop. Assuming that the source electrode potential Vs at this time is represented by Vc, the threshold voltage of the thin film transistor 15 becomes Vg−Vc.

Since the potential Vg is a known value because it is provided from the data line 7, the controller 8 detects the value of the source electrode potential Vs (=Vc) at the time when the inflow of the current from the current source 12 stops, which allows the threshold voltage of the thin film transistor 15 to be obtained. It is known that the time required between turning on the thin film transistor 15 and turning it off is about one second, based on an empirical rule. Actually, the controller 8 detects the potential Vs of the grounding electrode after about one second elapses from when the thin film transistor 15 becomes on-state, and thereby the threshold voltage is obtained.

Figure 4:
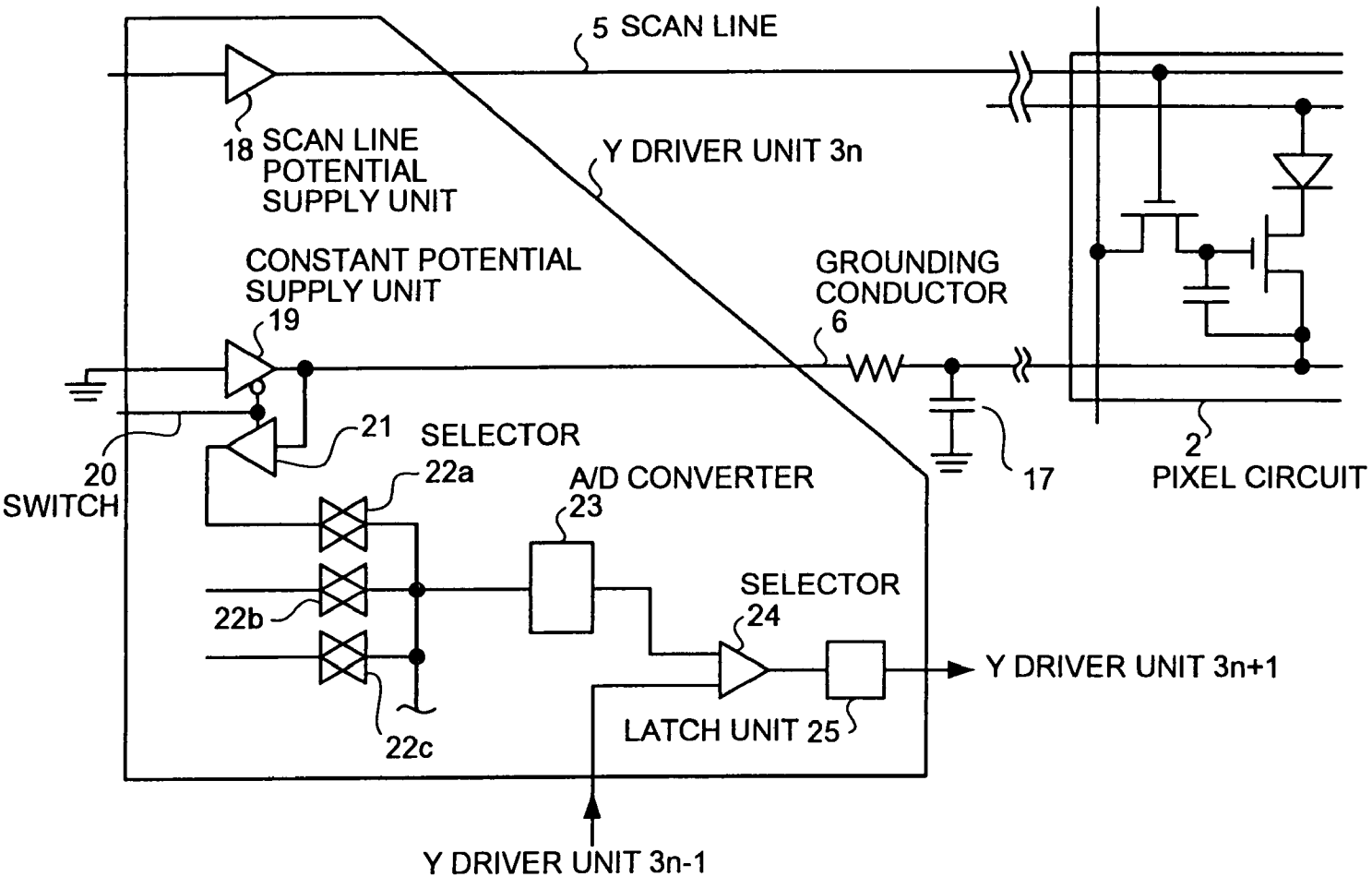
FIG. 4 is a diagram of a configuration of a Y driver unit that forms the image display apparatus.

A configuration in which in each of a large number of pixel circuits 2 that are arranged in a matrix on the organic EL panel 1, the source electrode potential of the thin film transistor 15 is transmitted to the controller 8, is explained below. FIG. 4 is a diagram of the configuration of a Y driver unit 3*n* that forms the Y driver 3 in the image display apparatus according to the first embodiment. A mechanism of transmitting a source electrode potential to the controller 8 is explained with reference to FIG. 4. The source electrode potential is obtained from the grounding conductor that belongs to a plurality of pixel circuits.

Referring to the configuration shown in FIG. 4, the Y driver 3 has a configuration such that a plurality of units control the pixel circuits arranged in the matrix across a plurality of rows. Here, the pixel circuits 2 are M×N-arranged on the organic EL panel 1 for convenience. Analog signals corresponding to the source electrode potentials Vs of the thin film transistors 15 are input to the units that form the Y driver, through the grounding conductor 6. The thin film transistors 15 belong to the plurality of pixel circuits 2 arranged over rows of m pieces (m<M). The analog signals are converted to digital signals. The Y driver unit 3*n* as shown in FIG. 4 can receive an electrical signal from a Y driver unit 3*n*−1 (not shown) provided in a previous stage and outputs the electrical signal to a Y driver unit 3*n*+1 (not shown) provided in a subsequent stage.

The Y driver unit 3*n* includes the scan line potential supply unit 18 connected to the scan line 5, the constant potential supply unit 19 and a selector 21 that are connectable to the grounding conductor 6, and the switch 20 that controls connection to the grounding conductor 6. The Y driver unit 3*n* also includes an A/D converter 23 that converts an analog signal having passed through the selector 21 to a digital signal, and the digital signal converted in the A/D converter 23 is output to the outside.

Selectors 22*a* to 22*c* arranged between the selector 21 and the A/D converter 23 are used to select an analog signal to be input to the A/D converter 23. As explained above, the Y driver unit 3*n* outputs data from the pixel circuits arranged over the plurality of rows. In order to realize such a function, the selectors 22*a* to 22*c* can receive electrical signals from different grounding conductors. The selectors 22*a* to 22*c* are sequentially selected to input the electrical signals received to the A/D converter 23, which allows values of the potentials Vs in the pixel circuits arranged along the different rows to be output as continuous data.

The Y driver unit 3*n* also has a configuration such that the electrical signal output from the Y driver unit 3*n*−1 provided in the previous stage is relayed to be output to the Y driver unit 3*n*+1 provided in the subsequent stage. More specifically, the Y driver unit 3*n* includes a selector 24 that passes either one of the electrical signal output from the A/D converter 23 and the electrical signal input from the Y driver unit 3*n*−1, and a latch unit 25 that controls the selector 24.

The operation of the Y driver unit 3*n* when a threshold voltage is to be measured is explained below. At first, the electrical signal input from the Y driver unit 3*n*−1 that is provided in the previous stage passes through the selector 24 and the latch unit 25 to be output to the Y driver unit 3*n*+1 that is provided in the subsequent stage. After input of the signal from the Y driver unit 3*n*−1 is finished, the selector 24 is switched under the control of the latch unit 25. The electrical signal input from the pixel circuit 2 through the grounding conductor 6 is digitized in the A/D converter 23 and passes through the selector 24 and the latch unit 25 to be output to the Y driver unit 3*n*+1. The selectors 22*a* to 22*c* are sequentially switched to successively convert the electrical signals, which are input from the pixel circuits that are arranged across different rows, to digital signals, and the digital signals are output to the Y driver unit 3*n*+1.

In other words, when the threshold voltage is to be obtained, the Y driver unit 3*n* first transmits the electrical signal obtained in the Y driver unit 3*n*−1 that is positioned in the previous stage to the Y driver unit 3*n*+1 in the subsequent stage. Then, the Y driver unit 3*n* outputs the electrical signal obtained in itself to the Y driver unit 3*n*+1 in the subsequent stage. The operation of the Y driver unit 3*n*+1 provided in the subsequent stage is similar to that mentioned above. The Y driver unit 3*n*+1 first transmits the electrical signal input from the Y driver unit 3*n* in the previous stage to a Y driver unit 3*n*+2 (not shown) in the subsequent stage. Then, the Y driver unit 3*n*+1 outputs the electrical signal obtained in itself to the Y driver unit 3*n*+2. Therefore, among the units forming the Y driver 3, a Y driver unit positioned in the final stage outputs the electrical signals obtained from all the Y driver units to the controller 8 as continuous data.

The threshold voltage of the driver element in the individual pixel circuits is obtained in the controller 8, and stored in the storage unit 9 by being associated with each pixel circuit. The threshold voltage is obtained by previously storing a potential Vg of the data line 7 upon obtaining the threshold voltage, in the storage unit 9, and calculating Vg−Vs in the controller 8. For performing image display, the threshold voltage Vth and data voltage VD that is supplied from the video signal supply unit 10 and corresponds to a display image are added in the adder 11, $V_D$+Vth is provided to the respective driver elements through the data line 7, and the organic EL element emits light with a brightness corresponding to the potential.

Advantages of the image display apparatus according to the first embodiment are explained below. The image display apparatus can compensate for a threshold voltage without provision of the voltage compensation circuit in the organic EL panel 1. Because the voltage compensation circuit is possible to be omitted, an area occupied by the pixel circuits 2 on the organic EL panel 1 can be increased. Therefore, it is possible to arrange a larger number of pixel circuits 2 on the same area of the organic EL panel 1 and realize an image display apparatus capable of displaying a high-definition image. It is also possible to upsize the thin film transistor and the organic EL element that form the pixel circuit 2. In this case, for example, a thin film transistor with a thick channel layer is arranged to allow a high-mobility switching element to be realized and an image display apparatus capable of potential writing within a short period of time to be realized.

Furthermore, by omitting the voltage compensation circuit, manufacturing yield of the organic EL panel 1 can be improved as compared with the conventional technology. As explained above, the voltage compensation circuit requires a few pieces of thin film transistors. Therefore, if an organic EL display panel including the voltage compensation circuit is to be manufactured, it is required to form the thin film transistors twice or more in number as compared with the organic EL display panel without the voltage compensation circuit. The manufacturing yield lowers as the number of thin film transistors increases. Therefore, in the first embodiment in which the voltage compensation circuit is omitted, it is possible to improve the manufacturing yield by the reduced number of thin film transistors.

The image display apparatus according to the first embodiment obtains the threshold voltage based on the grounding conductor 6 in a practically floating state. Therefore, the image display apparatus has also an advantage such that there is no need to separately provide circuitry for obtaining the threshold voltage on the organic EL panel 1. Because the grounding conductor 6 electrically connects the anode of the organic EL element 13 to the ground, the grounding conductor 6 has been provided in the conventional technology. Therefore, there is another advantage such that the threshold voltage can be obtained by using the grounding conductor 6 without provision of another circuitry on the organic EL panel 1.

There is still another advantage acquired by using the grounding conductor 6. In the first embodiment, the threshold voltage is obtained by using charges accumulated on the grounding conductor in a floating state, but in such a mode, a predetermined time is required for accumulation of charges on the grounding conductor in a floating state. However, the grounding conductor 6 exists in each row formed by many pixel circuits 2, and is arranged by the number of lines equal to the number of rows of the pixel circuits 2 that are arranged in a matrix. The individual grounding conductors 6 are simultaneously made to change to a floating state, and the charge for obtaining the threshold voltage can be accumulated simultaneously on the respective grounding conductors 6. The pixel circuits that belong to the same column are electrically connected to the same data line 7. Therefore, the driver elements belonging to the pixel circuits that are arranged in the same column can be simultaneously turned on by the potential supplied from the single data line 7, which allows the threshold voltages of the pixel circuits that belong to the same column to be obtained at a time.

Furthermore, the image display apparatus according to the first embodiment has a configuration such that a threshold voltage of the driver elements in the individual pixel circuits is directly measured and a potential in consideration of variations in the threshold voltage is supplied from the data line 7 to the pixel circuits 2. Therefore, it is possible to accurately detect variations in the threshold voltage of the individual driver elements and highly precisely suppress brightness variations in the organic EL element 13 due to the variations in the threshold voltage.

An image display apparatus according to a second embodiment is explained below. The image display apparatus has a configuration such that, although the configuration is basically the same as that of the first embodiment, a gate-source voltage is measured a plurality of times before it reaches a threshold voltage when the threshold voltage is to be obtained using a grounding conductor in a floating state, and that measured data is subjected to a predetermined computation to obtain the threshold voltage. Furthermore, in the second embodiment, a potential to be supplied from the data line 7 to the driver element is determined in consideration of variations in a change amount. The change amount is in a range (hereinafter, "linear area") in which not only the threshold voltage but also the value of a current passing through a channel layer almost linearly changes with respect to a change in the gate-source voltage.

Figure 5:
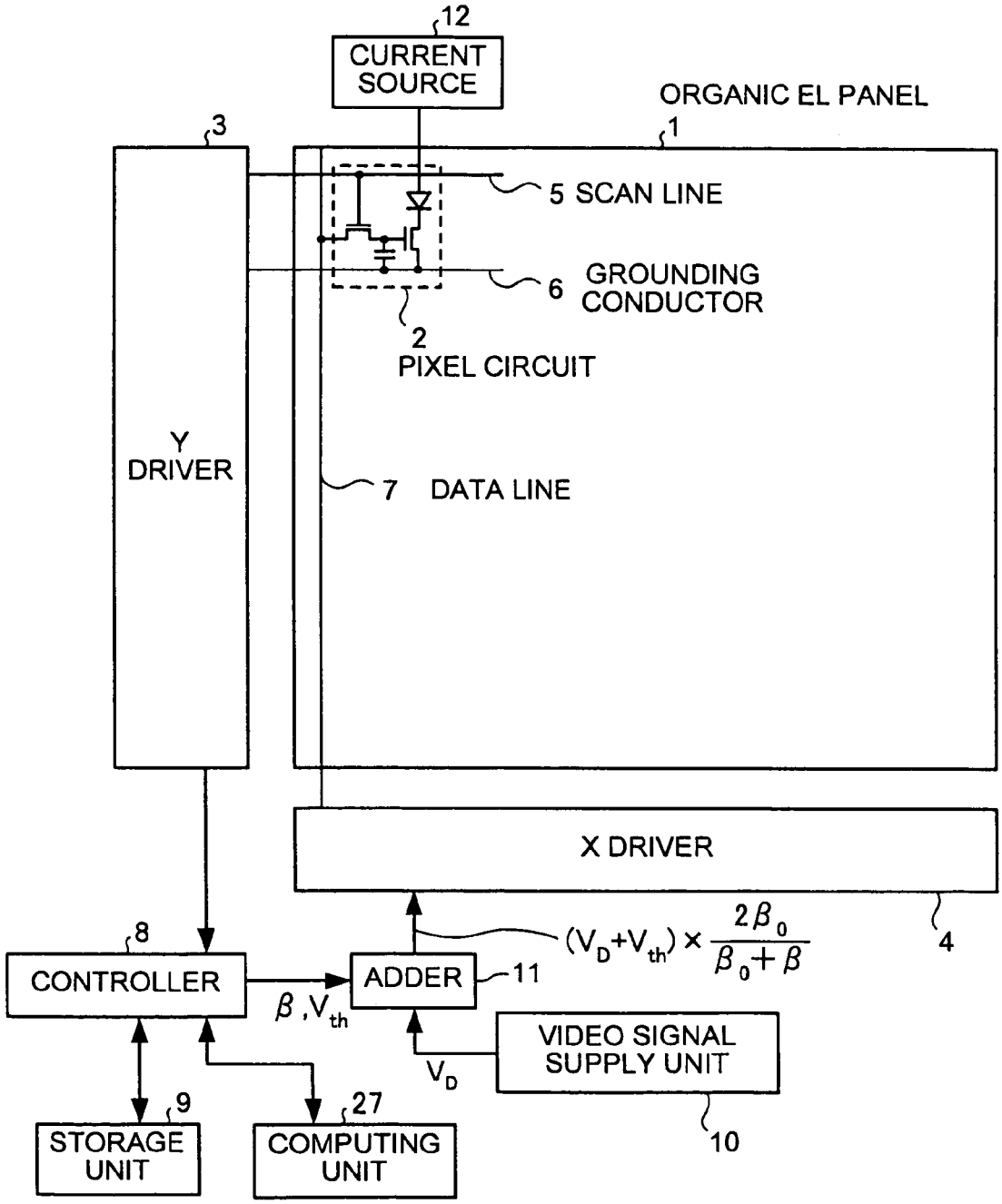
FIG. 5 is a diagram of an entire configuration of an image display apparatus according to a second embodiment.

FIG. 5 is a diagram of the configuration of the image display apparatus according to the second embodiment. As shown in FIG. 5, the image display apparatus according to the second embodiment includes the organic EL panel 1 with the pixel circuits 2 that are arranged in a matrix, the Y driver 3 connected to the organic EL panel 1 through the scan line 5 and the grounding conductor 6, and the X driver 4 connected thereto through the data line 7. The image display apparatus according to the second embodiment also includes the controller 8 that can input an electrical signal from the Y driver 3, a computing unit 27 that performs a predetermined computation based on the electrical signal provided from the controller 8 and outputs the result of computation to the controller 8, and the storage unit 9 that inputs the result of computation through the controller 8 to store it and outputs the result of computation to the controller 8 according to the request from the controller 8. Furthermore, the image display apparatus according to the second embodiment includes the video signal supply unit 10 that outputs an electrical signal corresponding to a display image, and the adder 11 that adds the electrical signal output from the video signal supply unit 10 and the electrical signal output from the controller 8 to supply the result of addition to the X driver 4. It is noted that in the second embodiment, components assigned with the same names and reference signs as those in the first embodiment have the equivalent configurations and functions to those in the first embodiment unless otherwise specified below, and therefore, explanations thereof are omitted. Furthermore, the image display apparatus according to the second embodiment has the configurations corresponding to those in FIG. 2 and FIG. 4 like in the first embodiment.

In the image display apparatus according to the second embodiment, like in the first embodiment, the grounding conductor 6 is made to be a floating state when a threshold voltage is to be obtained, and obtains, through the grounding conductor 6, the threshold voltage of the thin film transistor 15 by using the source electrode potential of the thin film transistor 15 that is the driver element. However, the image display apparatus according to the second embodiment does not measure the source electrode potential after the thin film transistor 15 becomes off-state, but measures the source electrode potential a plurality of times through the grounding conductor 6 while the thin film transistor 15 maintains its on-state, that is, before the gate-source voltage of the thin film transistor 15 reaches the threshold voltage. The image display apparatus performs a computation based on the source electrode potential obtained, and detects a threshold voltage of the thin film transistor 15 and a variation of the slope of the volt-ampere characteristic in the linear area.

Figure 6A:
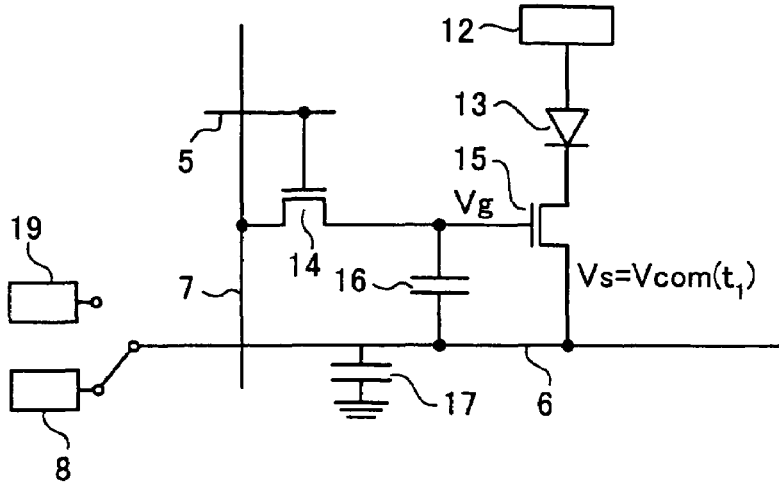
FIGS. 6A, 6B, and 6C are diagrams for explaining operations of the image display apparatus according to the second embodiment.
Figure 6B:
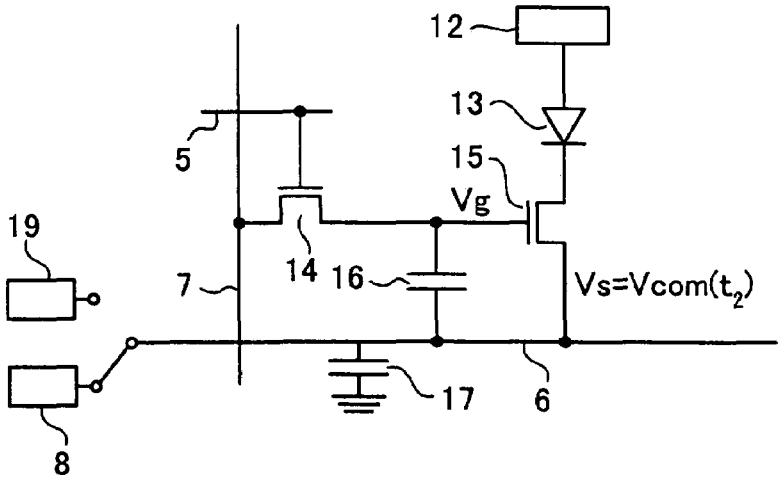
Figure 6C:
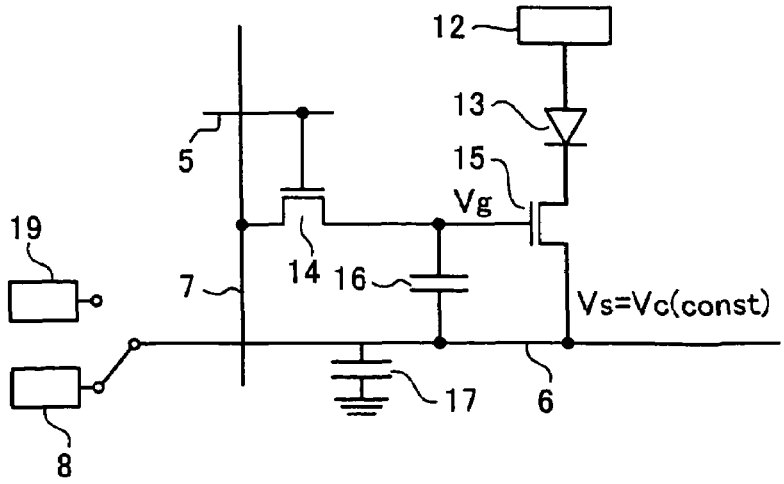
Figure 7:
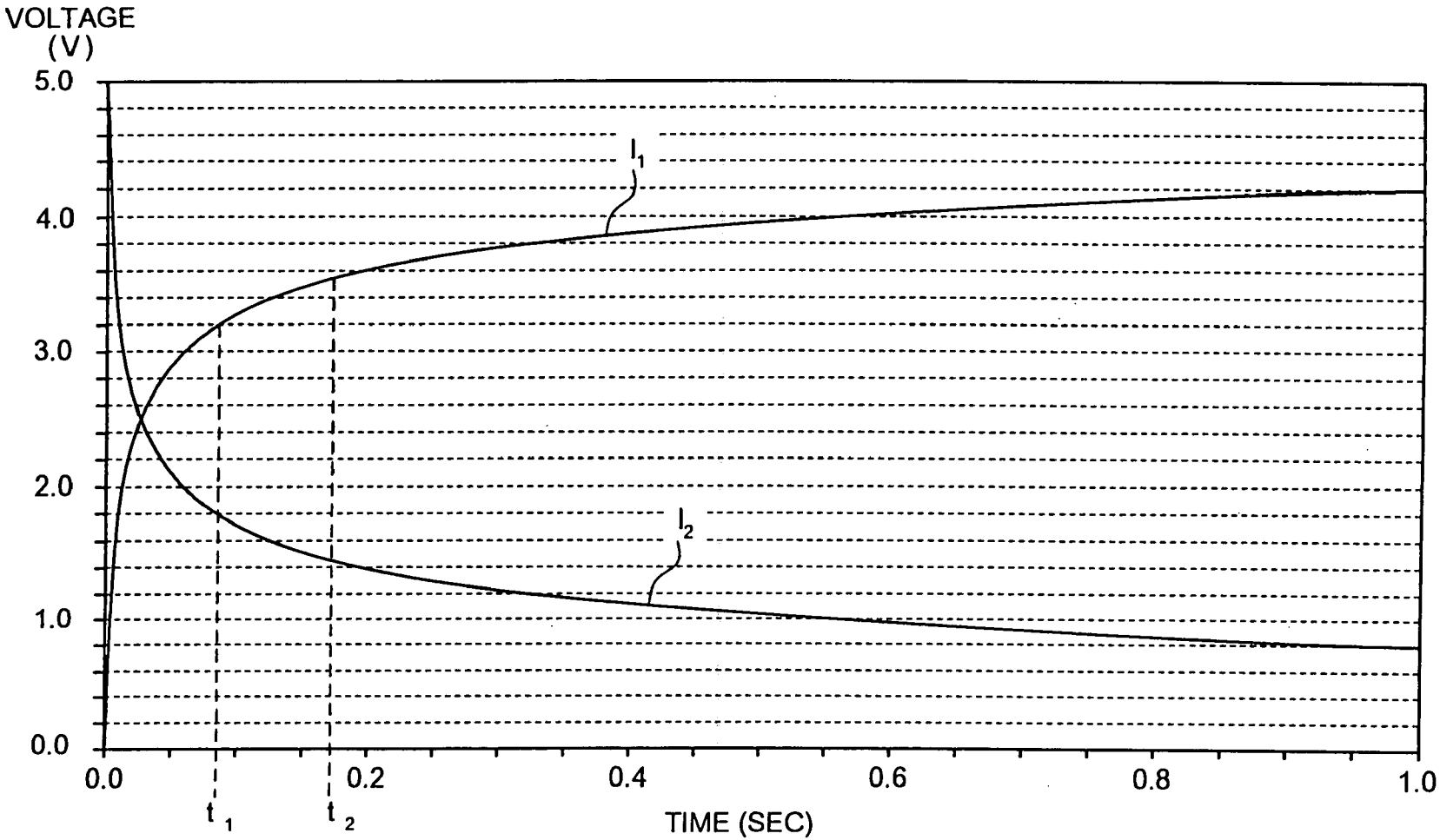
FIG. 7 is a graph of a temporal change of a source electrode of a thin film transistor as a driver element and a temporal change of a gate-source voltage upon obtaining a threshold voltage.

FIG. 6A to FIG. 6C are diagrams for illustrating process of measuring source electrode potentials of the thin film transistor 15 according to the second embodiment. FIG. 7 is a graph of a variation in source electrode potential of the thin film transistor 15 upon measuring the source electrode potential and of a variation in the gate-source voltage. As shown in FIG. 7, a curve 1, represents a variation in the source electrode potential and a curve 12 represents a variation in the gate-source voltage. Measurement of the source electrode potential is explained below with reference to FIG. 6A to FIG. 6C and FIG. 7.

As shown in FIG. 6A, a connection destination of the grounding conductor 6 is switched to the controller 8 by the switch 20 to cause the potential of the scan line 5 to rise, and the thin film transistor 14 as the switching element is made to be on-state. The gate electrode of the thin film transistor 15 is provided with a potential Vg supplied from the data line 7 to become on-state, which allows a current to pass through the organic EL element 13 and the channel layer of the thin film transistor 15. The state of the grounding conductor 6 is changed to a floating state caused by such a current, and charges are accumulated in the grounding conductor 6. A source electrode potential Vs of the thin film transistor connected to the grounding conductor 6 becomes Vcom ($t_1$) at the time $t=t_1$. The source electrode potential Vs in the second embodiment is first measured at $t=t_1$ to obtain Vs=Vcom ($t_1$).

Then, as shown in FIG. 6B, the source electrode potential is measured again at $t=t_2$ after a predetermined time has passed from t=μl. Since charges are further accumulated in the grounding conductor 6 in the floating state caused by the inflow current until $t=t_2$, the source electrode potential Vs of the thin film transistor 15 also rises higher at $t=t_2$ as compared with that at $t=t_1$. Therefore, the source electrode potential Vs at the time $t=t_2$ ($>t_1$) becomes $Vcom(t_2)$ that is different from $Vcom(t_1)$ as shown in FIG. 7. In the process as shown in FIG. 6B, the source electrode is measured at $t=t_2$, and then measurement of the source electrode is finished.

As shown in FIG. 6C, the source electrode potential Vs of the thin film transistor 15 further rises, and the thin film transistor becomes off-state at the time when the value of the potential Vs becomes Vc in which a difference value from the gate potential Vg is equal to the threshold voltage. As shown in FIG. 7, about one second is required for causing the state to change to a state of FIG. 6C, but in the second embodiment as explained above, the measurement is finished before the state becomes the state of FIG. 6C. Therefore, the time required for obtaining the threshold voltage of the thin film transistor 15 is shorter than one second.

The computing process performed in the computing unit 27 based on the result of measuring the source electrode potentials Vs as shown in FIG. 6A to FIG. 6C is explained below. There is a relation as follows among the source electrode potential Vs of the thin film transistor 15, the threshold voltage Vth of the thin film transistor 15, and the gate electrode potential Vg of the thin film transistor 15 supplied from the data line 7 upon measurement.

$$Vs(t)=Vg-Vth-[(\beta t/2Cp)+\{1/(Vg-Vth)\}]^{-1} \quad (1)$$

where Cp is a total sum of a capacitance of the source electrode of the thin film transistor 15 and a capacitance of an interconnect electrically and directly connected to the source electrode (that is, the same potential). Note that the gate electrode potential Vg when the potential Vs is to be measured satisfies a relation of Vd>Vg with respect to a source-drain voltage Vd of the thin film transistor 15. In the image display apparatus according to the second embodiment, the grounding conductor 6 is electrically and directly connected to the source electrode, and therefore, the total sum is a value obtained by summing a capacitance of the capacitor 16 that is positioned between the grounding conductor 6 and the gate electrode of the thin film transistor 15 and a capacitance of the parasitic capacitor 17 between the grounding conductor 6 and another interconnect structure. In the second embodiment, since all the pixel circuits 2 positioned in the same row with respect to one line of the grounding conductor 6 have a configuration that includes the capacitor 16, it is required to sum all the capacitances. It is noted that in the second embodiment, values of Cp and Vg are previously stored in the storage unit 9 and the values are supplied to the computing unit 27 through the controller 8 when they are to be computed.

Furthermore, in the equation (1), a coefficient β is a value that is determined based on the mobility and the shape of the channel layer of the thin film transistor 15. The coefficient β and the threshold voltage Vth are values that gradually vary caused by the long-term use of the thin film transistor. However, no practical problem is brought about by negligence of variations in the relation of $t_1 \leqq t \leqq t_2$, and therefore, calculation is performed in the computing unit 27 as if the value is time-independent in this time range.

In the equation (1), Cp and Vg are known values, and Vs(t) is a value obtained by measurement. In other words, Cp is a value obtainable from the circuit configuration and can be thought as a known value when the source electrode potential is measured. Further, Vg is a value supplied from the data line 7 and can be handled as a known value because this value is controlled by the X driver 4. Furthermore, Vs(t) is a value measured at the processes as shown in FIG. 6A and FIG. 6B.

Accordingly, unknowns in the equation (1) are Vth and the coefficient β. Therefore, in the second embodiment, values at different times $t_1$ and $t_2$ are substituted in the equation (1) to create two equations with Vth and the coefficient β as variables. By solving the simultaneous equations, Vth and the coefficient β are obtained. The image display apparatus according to the second embodiment obtains a threshold voltage of the thin film transistor 15 by performing the processes in the computing unit 27.

Furthermore, the image display apparatus according to the second embodiment can more accurately compensate for the electrical characteristic of the thin film transistor 15 that varies caused by the long-term use, by obtaining the coefficient β in the computing unit 27. The long-term use of the thin film transistor 15 causes not only the threshold voltage but also the slope of the linear area to change. In the slope of the linear area, the value of a current passing through the channel layer changes according to a change in the gate-source voltage. Therefore, in order to maintain the value of the current passing through the channel layer at a uniform level, it is required to determine a potential to be supplied from the data line 7 in consideration of such a change of the slope. The change of the slope due to the long-term use is proportional to a difference value between an initial value $\beta_0$ of a coefficient β and the coefficient β, and more accurately, a change amount Δa of the slope of the linear area is given by the following equation.

$$a=(\beta-\beta_0)/2\beta_0 \quad (3)$$

Therefore, in order to compensate for variation in the coefficient β in the thin film transistor 15 in which the characteristic varies, the potential of (−ΔaxVg) needs to be added to the value of the potential Vg supplied from the data line 7. In other words, if the variation in the threshold voltage and the variation in the coefficient β are considered, the potential Vg to be actually supplied from the data line 7 to the gate electrode of the thin film transistor 15 is required to satisfy the following relational equation.

$$Vg=Vth+V_D-\{(\beta-\beta_0)/2\beta_0\}\times V_D \quad (4)$$

In the image display apparatus according to the second embodiment, the adder 11 obtains Vg according to the equation (4) based on Vth and the coefficient β obtained in the computing unit 27, and based on $V_D$ supplied from the video signal supply unit 10, and the electrical signal corresponding to Vg is supplied to the X driver 4.

Advantages of the image display apparatus according to the second embodiment are explained below. At first, in the image display apparatus according to the second embodiment, like in the first embodiment, the voltage compensation circuit can be omitted.

Therefore, it is possible to realize an image display apparatus capable of displaying a high-definition image and to upsize the organic EL element and the thin film transistor. Further, since the number of pieces of thin film transistors can be reduced, the manufacturing yield can be improved. Furthermore, by using the grounding conductor 6, a threshold voltage is detected in the outside of the organic EL panel 1. Accordingly, there is no need to provide a specific circuit in the organic EL panel 1 in order to detect the threshold voltage, which allows a large number of grounding conductors 6 to be provided and threshold voltages of a large number of thin film transistors to be obtained at a time.

In the image display apparatus according to the second embodiment, the source electrode potential is detected before the thin film transistor 15 becomes off-state, which allows the threshold voltage to be obtained within a shorter period of time. That is, about one second is generally required between turning on once the thin film transistor 15 and turning it off. On the other hand, in the second embodiment, times t1 and t2 are within about 0.2 second as shown in FIG. 7. Actually, a source electrode potential can be detected a plurality of times within a shorter period of time than that of the example of FIG. 7. It is therefore possible to detect a source electrode potential the required number of times within, for example, 0.01 second. Consequently, the required time becomes about 1/100 as compared with the case where the source electrode potential is detected after the thin film transistor 15 becomes off-state, which makes it possible to obtain a threshold voltage within an extremely short period of time. For example, even if the image display apparatus according to the second embodiment is a super extended graphics array (SXGA) type, the time required to obtain the threshold voltages of the driver elements that belong to all the pixel circuits is 15 seconds or less.

Furthermore, the image display apparatus according to the second embodiment obtains the threshold voltage and the value of the coefficient β, and therefore, it is possible to compensate for variations of the slope of the linear area in the volt-ampere characteristic of the thin film transistor 15. More specifically, the potential Vg supplied from the data line 7 is compensated for by the change amount Δa of the slope as shown in the equation (3), which makes it possible to more precisely compensate for the variations of the characteristic of the thin film transistor 15.

An image display apparatus according to a third embodiment is explained below. The image display apparatus has a configuration such that, although it is basically the same as that of the first embodiment and the second embodiment, after the source electrode of a thin film transistor is measured by using a grounding conductor in the floating state, the threshold voltage of the thin film transistor and the coefficient β are obtained by referring to a database to adjust a potential to be supplied from a data line.

Figure 8:
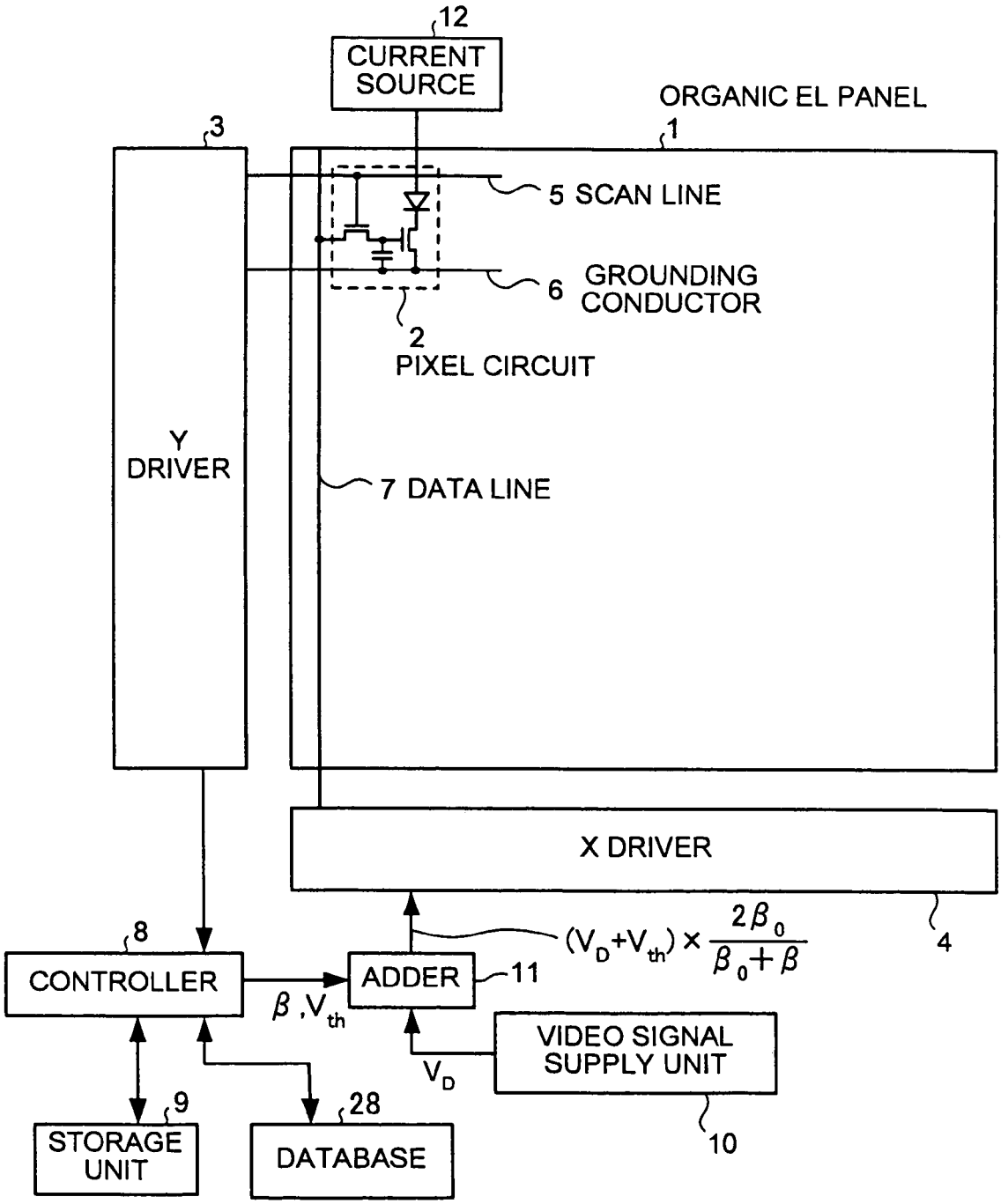
FIG. 8 is a diagram of an entire configuration of an image display apparatus according to a third embodiment.
Figure 9:
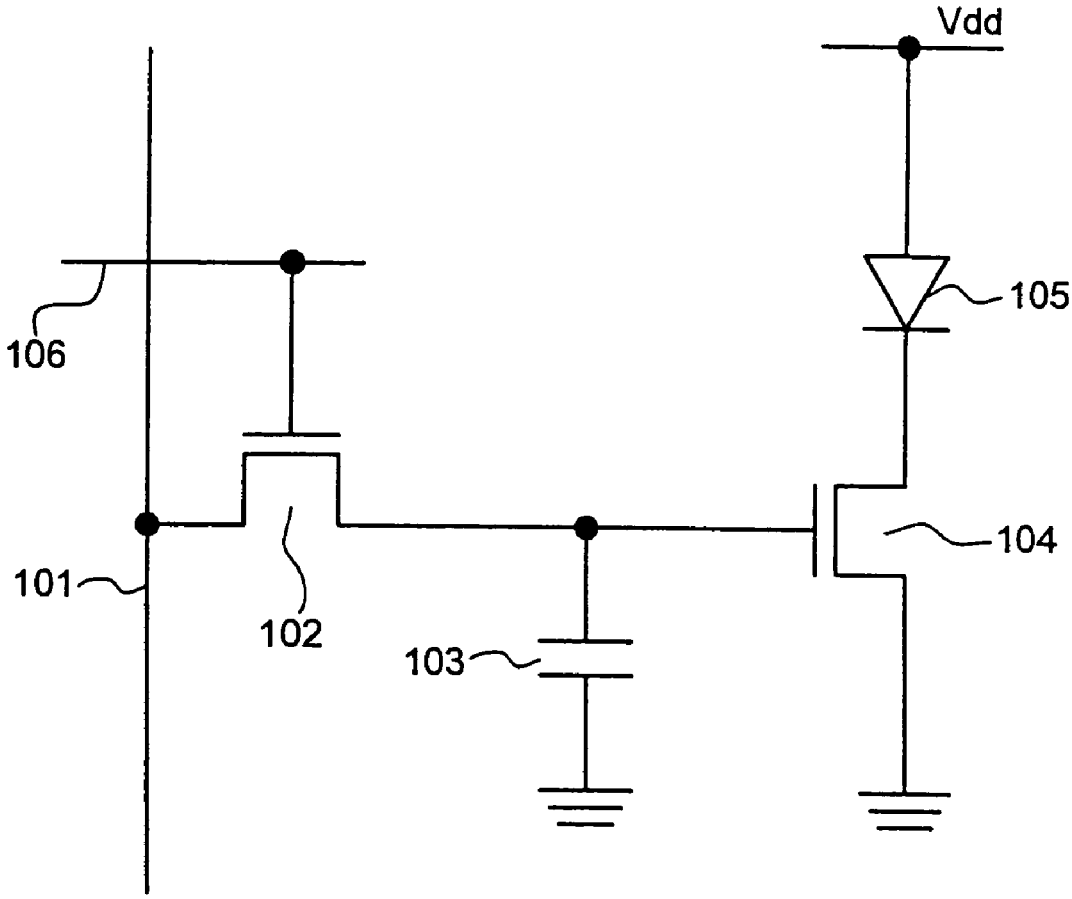
FIG. 9 is an equivalent circuit diagram of a configuration of a pixel circuit that forms the image display apparatus according to the conventional technology.

FIG. 8 is a diagram of the entire configuration of the image display apparatus according to the third embodiment. As shown in FIG. 8, the image display apparatus according to the third embodiment includes the organic EL panel 1 with the pixel circuits 2 that are arranged in a matrix, the Y driver 3 connected to the organic EL panel 1 through the scan line 5 and the grounding conductor 6, and the X driver 4 connected thereto through the data line 7. The image display apparatus according to the third embodiment also includes the controller 8 that can input an electrical signal from the Y driver 3, a database 28 which a threshold voltage and a value of coefficient β can be referred to based on a value of the electrical signal input to the controller 8, and the storage unit 9 that stores the threshold voltage and the value of the coefficient β obtained by referring to the database 28. Furthermore, the image display apparatus includes the video signal supply unit 10 that outputs an electrical signal corresponding to a display image, and the adder 11 that adds the electrical signal output from the video signal supply unit 10 and the electrical signal output from the controller 8 to supply the result of addition to the X driver 4. It is noted that in the third embodiment, components assigned with the same names and reference signs as those in the first embodiment and the second embodiment have the equivalent configurations and functions to those in the first embodiment unless otherwise specified below, and therefore, explanations thereof are omitted.

The image display apparatus according to the third embodiment, like in the first embodiment and the second embodiment, causes the grounding conductor 6 to be a floating state when a threshold voltage is to be obtained, and measures, through the grounding conductor 6, a source electrode potential of the thin film transistor 15 that is the driver element. However, the image display apparatus according to the third embodiment measures the potential before a gate-source voltage reaches a threshold voltage, unlike the first embodiment and the second embodiment, to obtain the threshold voltage and the coefficient by referring to the database 28 based on the result of measurement.

Various modes of data structure of the database 28 can be considered. One of data structures is a structure in which a threshold voltage and a coefficient β are recorded with respect to a source electrode potential when a predetermined time has elapsed since measurement is started. If the shape of a channel layer of the thin film transistor 15 and a crystalline structure of silicon that forms the channel layer are known, the tendency of a variation pattern of the threshold voltage and the coefficient β is somewhat apparent empirically. Therefore, the threshold voltage and the coefficient β can be obtained with a predetermined level of accuracy even if the source electrode potential is not measured a plurality of times. They are measured a plurality of times, and the database 28 may be referred to based on the result of measurement. The adder 11 performs calculation based on the equation (4) by using the threshold voltage and the coefficient β obtained to output the result of calculation to the X driver 4, which allows a supply of the potential Vg in which variations in the characteristic of the thin film transistor 15 are compensated for.

As parameters used to refer to the database 28, anything other than the source electrode potential may be used. For example, the characteristic of the thin film transistor 15 changes according to the use period, more accurately, according to the amount of carrier that passes through the channel layer of the thin film transistor 15. Therefore, in addition to the source electrode potential, the use period and an average value of amounts of current that passes through the channel layer when the thin film transistor 15 is used are previously obtained to store them in the storage unit 9, and by using the values stored as reference parameters, the threshold voltage and the like can be obtained with more accuracy. Furthermore, the threshold voltage Vth is obtained in the same manner as that of the first embodiment, and the database 28 may be referred to by using the values of the threshold voltage Vth to obtain the coefficient β.

As explained above, the image display apparatus according to the third embodiment is capable of reducing the time required for measurement of source electrode potential and the number of times of the measurement by using the database 28, in addition to the advantages of the first embodiment and the second embodiment. Furthermore, computation is not required to obtain the threshold voltage and the coefficient β, which allows realization of the image display apparatus with a simple configuration.

The first to third embodiments of the present invention have been explained so far, but the present invention is not limited to the described contents. Persons skilled in the art may think of various examples and modifications. For example, in the first to third embodiments, the image display apparatus has a configuration in which the controller 8 is provided separately from the Y driver 3 and the X driver 4.

However, the controller 8 or the like may be provided in the Y driver 3 or in the X driver 4.

Furthermore, in the second embodiment and the third embodiment, the coefficient β in addition to the threshold voltage is obtained. However, when the image display apparatus with a simple configuration is to be realized, the process of obtaining the coefficient β may be omitted and the potential Vg supplied from the data line 7 may be determined in consideration of only the variation in the threshold voltage. This is because the variation in the threshold voltage more largely affects the brightness of the organic EL element 13 than the variation in the coefficient β, and it is therefore possible to make the brightness of the organic EL element 13 uniform with a predetermined level of accuracy by considering only the variation in the threshold voltage.

The organic EL element is used as the current-controlled light emitting element in the first to third embodiments, but, for example, an inorganic EL element or a light emitting diode may be used as the current-controlled light emitting element. More specifically, any light emitting element in which brightness changes according to a value of inflow current may be used for the image display apparatus of the present invention. As for the interconnect structure used to measure a source electrode potential of the driver element, the grounding conductor 6 is not used but another interconnect structure may be provided.

Furthermore, the driver element of the present invention is based on the thin film transistor of which channel layer is formed of amorphous silicon. However, the present invention may be applied to the case where the driver element is formed with the thin film transistor of which channel layer is formed of polysilicon. When the channel layer is formed of polysilicon, variations in characteristics of the thin film transistor may occur in each pixel due to variations in particle size or the like. In order to compensate for the variations in the characteristics of the thin film transistor, application of the present invention allows the brightness of the current-controlled light emitting element such as the organic EL element to be uniform.

Moreover, in the first to third embodiments, the thin film transistor is used as the driver element. However, the present invention is applicable to any configuration, other than the configuration explained above, in which at least two terminals are provided and a passing current can be controlled by a voltage applied between the two terminals.

What is claimed is:

1. An image display apparatus comprising:

a display region having a plurality of pixels, each pixel comprising a current-controlled light emitting element that emits light with a brightness corresponding to a current flowing in the current-controlled light emitting element, a driver element that includes at least first and second terminals and controls the current flowing into the electric light emitting element based on a potential difference applied between the terminals, and a data line that supplies a potential to the first terminal, and a conductive member that is electrically connected to the second terminal; and a threshold voltage obtaining unit that obtains a threshold voltage of the driver element based on the potential of the conductive member corresponding to an amount of charges supplied from the current source to the second terminal, wherein the threshold voltage obtaining unit obtains a threshold voltage based on potentials of the conductive member at two or more different times after the driver element becomes on-state and before the driver element becomes off-state caused by rising of the potential of the conductive member up to a predetermined potential, and the threshold voltage obtaining unit obtains the threshold voltage, and obtains a mobility in a current passage portion of the driver element and a coefficient according to a shape of the current passage portion.

2. The image display apparatus according to claim 1, wherein the driver element becomes on-state by applying a potential higher than an estimated threshold voltage, between the first terminal and the second terminal upon staffing to obtain the threshold voltage, and the conductive member whose potential changes by accumulating charges supplied from the current source through the driver element and the current-controlled light emitting element so that the potential difference between the first and second terminals of the driver element shifts to the threshold voltage.

3. The image display apparatus according to claim 1, wherein the driver element becomes off-state caused by rising of the potential of the conductive member up to a predetermined potential after the driver element becomes on-state, and the threshold voltage obtaining unit obtains a threshold voltage based on the potential of the conductive member after the driver element becomes off-state.

4. The image display apparatus according to claim 1, wherein the threshold voltage obtaining unit obtains a threshold voltage using a total sum of a capacitance of the second terminal and a capacitance of a capacitor electrically connected to the conductive member and a potential applied to the first terminal, as parameters.

5. The image display apparatus according to claim 1, further comprising:

a database in which potentials of the conductive member and threshold voltages of the driver element are associated with each other, wherein the threshold voltage obtaining unit obtains a threshold voltage by referring to the database based on the potentials of the conductive member at one or more times after the driver element becomes on-state.

6. The image display apparatus according to claim 1, wherein a potential is supplied to the first terminal upon displaying an image so that a voltage between the first terminal and the second terminal becomes a sum of the threshold voltage obtained by the threshold voltage obtaining unit and a data voltage corresponding to a display image.

7. The image display apparatus according to claim 1, wherein the data line supplies a potential to the first terminal so that a voltage between the first terminal and the second terminal becomes a potential obtained by multiplying a sum of the threshold voltage obtained by the threshold voltage obtaining unit and a data voltage corresponding to a display image, by a value determined based on the mobility in the current passage portion of the driver element and the coefficient according to the shape of the current passage portion.

8. The image display apparatus according to claim 1, further comprising:

a constant potential supply unit that supplies a substantially constant potential upon displaying an image; and a switching unit that establishes a connection between the constant potential supply unit and the conductive member upon displaying the image, and isolates the constant potential supply unit from the conductive member upon obtaining the threshold voltage.

9. The image display apparatus according to claim 1, wherein the driver element is a thin film transistor, which includes a gate electrode, a source electrode, and a drain electrode, the first terminal corresponds to the gate electrode, and the second terminal corresponds to the source electrode.

10. The image display apparatus according to claim 1, wherein the current-controlled light emitting element is an organic electro-luminescence element.

* * * * *